United States Patent [19]

Nakamura et al.

[11] Patent Number: 4,830,146

[45] Date of Patent: May 16, 1989

[54] FLUID-PRESSURE ELEVATOR

[75] Inventors: Ichiro Nakamura; Toshihiko Nara, both of Katsuta, Japan

[73] Assignee: Hitachi, Ltd., Tokyo, Japan

[21] Appl. No.: 111,270

[22] Filed: Oct. 22, 1987

[30] Foreign Application Priority Data

Oct. 22, 1986 [JP] Japan ..... 61-249661

[51] Int. Cl.[4] ..... B66B 11/04

[52] U.S. Cl. ..... 187/26; 188/300

[58] Field of Search ..... 187/17, 20, 26, 6, 23, 187/1 R; 182/141, 12, 103, 148; 188/300

[56] References Cited

U.S. PATENT DOCUMENTS

| | | | |
|---|---|---|---|
| 3,966,182 | 6/1976 | Stadelmann et al. | 188/300 |
| 4,093,196 | 6/1978 | Bauer | 188/300 |
| 4,262,777 | 4/1981 | Christopher | 187/26 |
| 4,534,452 | 8/1985 | Ogasawara et al. | 187/29 A |

FOREIGN PATENT DOCUMENTS

| | | | |
|---|---|---|---|
| 1486182 | 6/1966 | France | 187/26 |
| 751212 | 6/1956 | United Kingdom . | |
| 943974 | 12/1963 | United Kingdom . | |
| 1102586 | 2/1968 | United Kingdom . | |
| 1231785 | 3/1969 | United Kingdom . | |
| 1170414 | 11/1969 | United Kingdom . | |
| 2058012 | 9/1980 | United Kingdom . | |
| 2181794 | 4/1987 | United Kingdom . | |

*Primary Examiner*—Joseph J. Rolla
*Assistant Examiner*—Kenneth Noland
*Attorney, Agent, or Firm*—Antonelli, Terry & Wands

[57] ABSTRACT

A fluid-pressure elevator comprising an elevator frame for supporting a cage; a fluid pressure cylinder attached to the elevator frame and adapted to vertically move the cage by controlling the rate of charge or discharge of pressure fluid; a rope means for connecting the cage and the plunger of the fluid pressure cylinder to each other while being supported by pulleys attached to upper portions of the elevator frame.

2 Claims, 4 Drawing Sheets

FLUID-PRESSURE ELEVATOR

BACKGROUND OF THE INVENTION

1. Field of the Invention

This invention relates to a fluid-pressure elevator in which a cage is vertically moved by a fluid-pressure cylinder which is charged and discharged with a pressure fluid, and relates more particularly to a fluid-pressure elevator suitable for use in a comparatively low building such as a small house.

2. Description of Prior Art

Hitherto, a fluid-pressure elevator of this type has a construction in which the cage is directly or indirectly moved in the vertical direction by controlling the supply of pressure fluid to or the discharge of the pressure fluid from a fluid pressure cylinder.

That is, the cage is directly supported by the plunger of the fluid pressure cylinder or supported indirectly by the plunger, pulleys and a rope, is moved upward by the pushing-up motion (extending motion) of the plunger caused by the pressure fluid, and is moved downward by the pushing-down motion (contracting motion) of the plunger.

This type of fluid pressure cylinder is disclosed in, for example, U.S. Pat. No. 4,534,452 (corresponding to Japanese Patent Application Laid-Open Publication No. 203074/84).

However, as mentioned above, the upward movement of the cage is caused by the pushing-up motion of the plunger of the cylinder, and in view of the plunger's buckling strength it is necessary to increase the diameter of the plunger. Therefore, the pressure of the pressure fluid is relatively low (10 to 30 kg/cm$^2$), and the sizes of hydraulic devices such as a flow rate control valve and a fluid pressure pump are increased, thereby resulting in increase in the cost and reduction in the energy efficiency.

SUMMARY OF THE INVENTION

It is therefore an object of the present invention to provide a fluid-pressure elevator designed to use small-sized hydraulic devices and to be manufactured at a lower cost.

To this end, the present invention provides a fluid-pressure elevator having an elevator frame for supporting a cage; a fluid pressure cylinder attached to the elevator frame and adapted to vertically move the cage by controlling the rate of charge or discharge of pressure fluid; and rope means for connecting the cage and the plunger of the fluid pressure cylinder to each other while being supported by pulleys attached to upper portions of the elevator frame.

BRIEF DESCRIPTON OF THE DRAWINGS

DESCRIPTION OF PREFERRED EMBODIMENTS

Preferred embodiments of the present invention will be described below with reference to the accompanying drawings.

Figure 1:
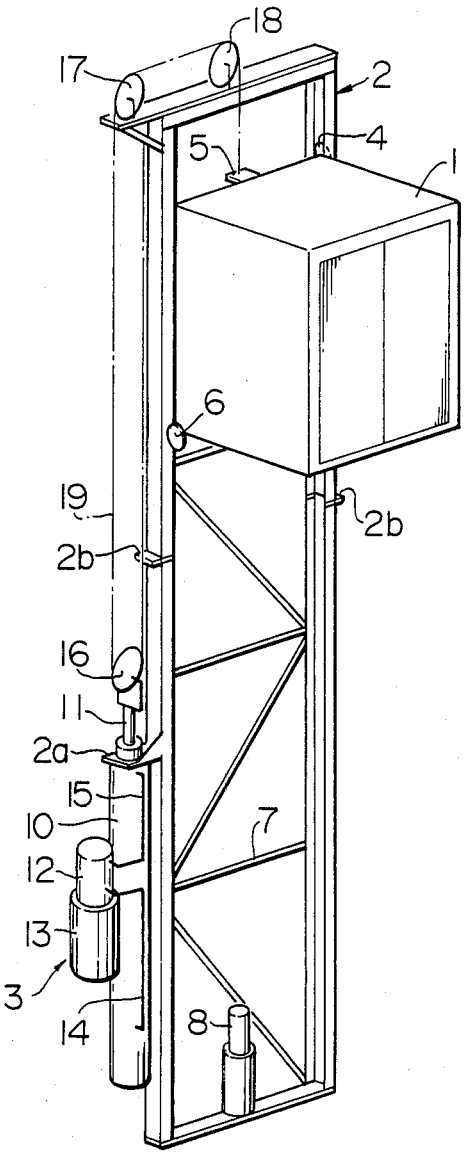
FIG. 1 is a perspective view of the entire construction of a fluid-pressure elevator which represents an embodiment of the present invention.

FIG. 1 shows a fluid-pressure elevator in accordance with the present invention which is installed in a small house, for example, a comparatively low, two-or three-storied building (not shown).

The elevator has a cage 1 and an elevator frame 2 which can support the cage 1 while the cage 1 moves vertically, and which has, for example, a truss structure and is fixedly installed in an elevator shaft (not shown) formed in the building.

The elevator frame 2 is of a self-standing type and is strong enough to support the weight of the cage 1. However, part of the frame 2 is fixed to the building so as to reinforce the frame and maintain its position relative to the building. The elevator frame 2 is assembled at the factory. If the elevator is designed to extend over a comparatively large number of stories, the frame may be partially assembled at the factory and thereafter completed by connecting the assembled units at the place in which the frame is to be installed. This connection is enabled by connecting members **2*b***.

A drive unit 3 is adapted to move the cage 1 along the elevator frame 2 in the vertical direction and is constituted by a fluid pressure cylinder 10, a hydraulic pump 12 for supplying a pressure fluid to the fluid pressure cylinder 10, a motor 13 for driving the hydraulic pump 12, and other components. The elevator also has a buffer 8 having safety functions to prevent accidents caused by abnormal downward movement of the cage 1; rollers 4 and 6 adapted to prevent the cage 1 from tipping over, the rollers 4 being disposed on the rear sides of frame members of the elevator frame, and the rollers 6 being disposed on the front sides of the frame members; reinforcement members 7 for reinforcing the frame; and a rope 19 for vertically moving the cage 1 by the driving force of the drive unit 3. One end of the rope 19 is fixed to a support plate 5 extending from the cage 1, and the other end is fixed to the elevator frame 2, intermediate portions of the rope being supported by pulleys 16, 17 and 18. The elevator also has piping 14 and 15 which connects the fluid pressure cylinder 10, the hydraulic pump 12, and a tank.

Switches and other elements necessary for the control of the elevator are previously disposed on the elevator frame.

Figure 2:
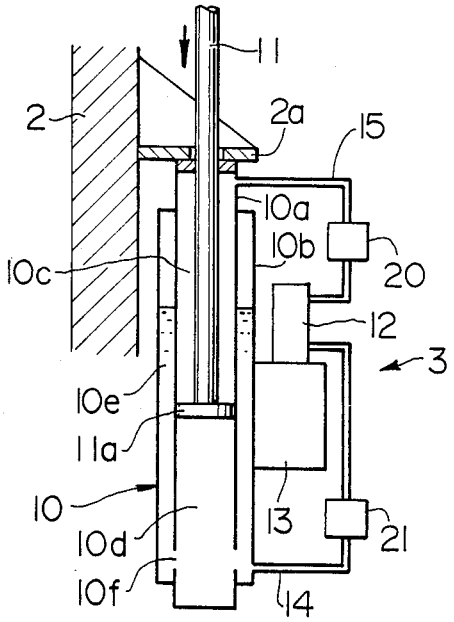
FIG. 2 is a cross-sectional view of a drive unit in accordance with the embodiment shown in FIG. 1.

FIG. 2 shows the construction of the drive unit 3 in which the fluid pressure cylinder 10 is fixed to a support plate **2*a* extending from a portion of the elevator frame 2, and is constituted by an inner cylinder 10*a* and an outer cylinder 10*b*. A piston 11*a* connected to a plunger 11 is inserted into the inner cylinder 10*a* so as to be slidable in the direction in which the plunger 11 extends or contracts. The cage 1 is moved upward when the plunger 11 moves in the contraction direction thereof, and the cage 1 is moved downward when the plunger 11 moves in the extension direction thereof. A lower fluid chamber 10***d* formed in the inner cylinder 10*a* below the piston 11*a* communicates with a fluid chamber 10*e* in the outer cylinder 10*b* via a communication hole 10*f*, and these chambers serve as a tank. When the hydraulic pump 12 is driven by the motor 13, it draws fluid from the fluid chamber 10*e* of the outer cylinder 10*b* and supplies pressure fluid to the fluid chamber 10*c* of the inner cylinder 10*a* at a high pressure. A control valve 20 is disposed at an intermediate position of the piping 15. The construction of the control valve 20 depends on the type of control system. That is, a check valve of a pilot operation type is used if the control of the speed at which the cage 1 is moved in the vertical direction is performed by the motor, or a flow rate control valve is used if the speed control is performed by the hydraulic pump operating at a constant discharge rate. A filter 21 is disposed at an intermediate position of the piping 14 on the suction side.

Figure 3:
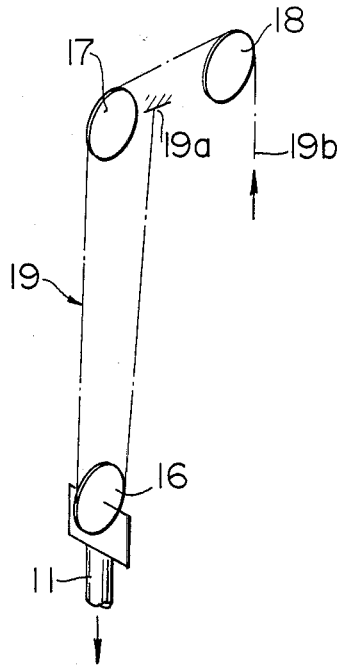
FIG. 3 is a schematic illustration of the stretched state of a rope in accordance the embodiment shown in FIG. 1.

FIG. 3 shows the stretched state of the rope in accordance with this embodiment. As shown in FIG. 3, one end of the rope 19 is fixed to a support plate 19*a* which extends from the elevator frame 2, and the other end 19*b* of the rope 19 is fixed to the support plate 5 which extends from the cage 1. The rope 19 passes around the pulleys 16, 17 and 18 before being connected to the cage 1. The pulley 16 is mounted on the top of the plunger 11 of the fluid pressure cylinder 10, and the pulleys 17 and 18 are mounted on the elevator frame 2.

The rope 19 is thus stretched between the pulleys 16, 17 and 18, thereby enabling the movement of the plunger 11 to be transmitted to the cage 1 after being doubled.

This embodiment of the present invention has exemplified the case in which the pump 12 and the motor 13 are directly connected to the fluid pressure cylinder 10.

The operation of the fluid-pressure elevator in accordance with the present invention will be described below.

When the cage 1 is moved upward, the hydraulic pump 12 is driven by the motor 13 in response to a command, and the pressure fluid is supplied from the pump 12 to the fluid chamber 10*c* of the inner cylinder 10*a* via the piping 15 while being controlled by the flow rate control valve 20. The plunger 11 is thereby moved in the inner cylinder 10*a* in the contraction direction thereof (in the direction indicated by the arrow in the figure) while being accelerated. This movement of the plunger 11 is transmitted to the cage 1 via the rope 19, and the pulleys 16, 17 and 18, and the cage 1 is accelerated and moved upward while being guided by the elevator frame 2. When it approaches the target stop position, the rate of supply to the fluid chamber 10*c* is reduced, thereby decelerating and stopping the cage 1. During this process, the hydraulic pump 12 draws the fluid contained in the fluid chambers 10*d* and 10*e* that serve as a tank and supplies this fluid of the fluid chamber 10*c* at a high pressure. Accordingly, the level of fluid rises to a degree corresponding to a volume of contraction of the plunger 11 into the fluid pressure cylinder 10, but this increment can be suitably allowed by the fluid chamber 10*e* of the outer cylinder 10*b*.

When the cage 1 is moved downward, the motor 13 and the pump 12 are driven in the direction opposite to that in the above lifting operation, and the plunger 11 is gradually moved in the extension direction thereof (in the direction opposite to that indicated by the arrow in the figure) by drawing fluid from the fluid chamber 10*c* via the control valve 20 to the fluid chamber 10*d* (in the case of speed control by the motor and the pump), or by controlling the rate of flow from the fluid chamber 10*c* to the fluid chamber 10*e* by the control valve 20 (in the case of speed control by the flow rate control valve 20).

This movement of the plunger 11 is transmitted to the cage 1 via the rope 19, and the pulleys 16, 17 and 18. The cage 1 is moved downward by its weight along the elevator frame 2. When it approaches the target stop position, the rate of flow from the fluid chamber 10*c* to the fluid chamber 10*c* in the fluid pressure cylinder 10 is reduced, thereby decelerating and stopping the cage 1.

In accordance with the above-described arrangement, a force, which occurs from the load or weight of the cage and which acts on the fluid pressure cylinder 10, has only a component which always acts in the direction in which the plunger 11 extends, that is, in the direction in which the plunger 11 is drawn. Therefore, there is no possibility of occurrence of any force in the direction of plunger contraction, namely, any compressive force such as that in the case of the conventional type of elevator and, hence, there is no possibility of buckling of the plunger 11. It is therefore possible to reduce the diameter of the plunger and, hence, the size of the cylinder, thereby enabling the use of a pressure fluid suitable for high-pressure operation. Thus, the sizes of hydraulic devices including the tank, the pump and the control valve can be greatly reduced. Reductions in the weight and size of the hydraulic devices enable reductions in the weight and production cost of the elevator frame.

Moreover, the use of high-pressure fluid makes the pressure losses in the hydraulic devices relatively small, thereby enabling energy saving. In addition, reductions in the sizes of the devices enable assembly and installation of the elevator to be facilitated and the production cost of the devices to be reduced.

Figure 4:
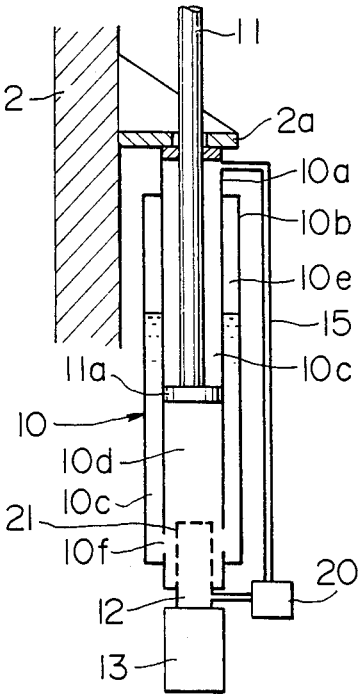
FIGS. 4 and 5 are cross-sectional view of a drive unit in accordance with other embodiments of the present invention.

FIG. 4 shows another embodiment of the present invention. In FIG. 4, the same reference symbols as those in FIG. 2 are used to indicate the same components.

In this embodiment, the hydraulic pump 12 is inserted into the fluid pressure cylinder 10 so that an outer peripheral portion of the pump 12 is used as a filter 21.

This construction further reduces the size of the fluid pressure drive unit and, hence, the production cost.

Figure 5:
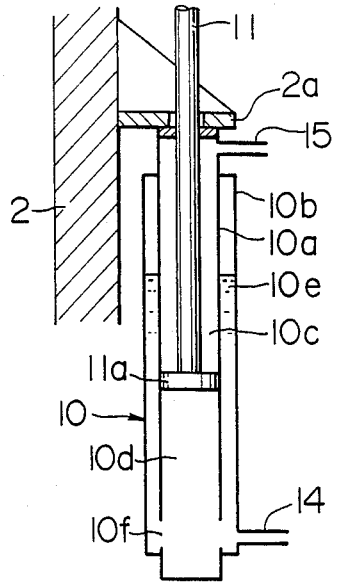

FIG. 5 shows a still another embodiment of the present invention, in which hydraulic devices such as a motor, a hydraulic pump and a control valve are disposed so as to be separate from the elevator frame 2 on which only the fluid pressure cylinder is mounted.

This arrangement eliminates the need for maintenance of the hydraulic devices in the elevator shaft and improves the maintainability of the hydraulic devices.

Figure 6:
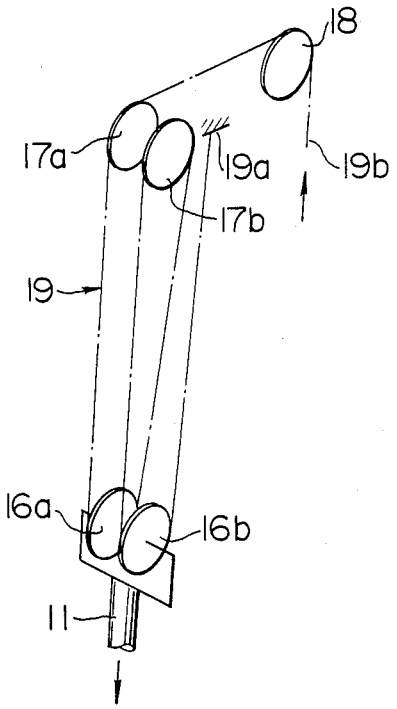
FIG. 6 is a schematic illustration of the stretched state of ropes in accordance with another embodiment.

FIG. 6 shows a still another embodiment of the present invention, in which two pulleys 16*b* and 17*b* are provided along with pulleys 16*a*, 17*a* and 18 so that the movement of the plunger 11 can be transmitted to the cage 1 after being quadrupled.

This roping enables the extent of movement of the plunger 11 of the fluid pressure cylinder 10 to be further reduced and the fluid pressure cylinder 10 to be used at a higher pressure, thereby resulting in a further reduction in the size of the hydraulic pump and improvement in the energy efficiency.

Figure 7:
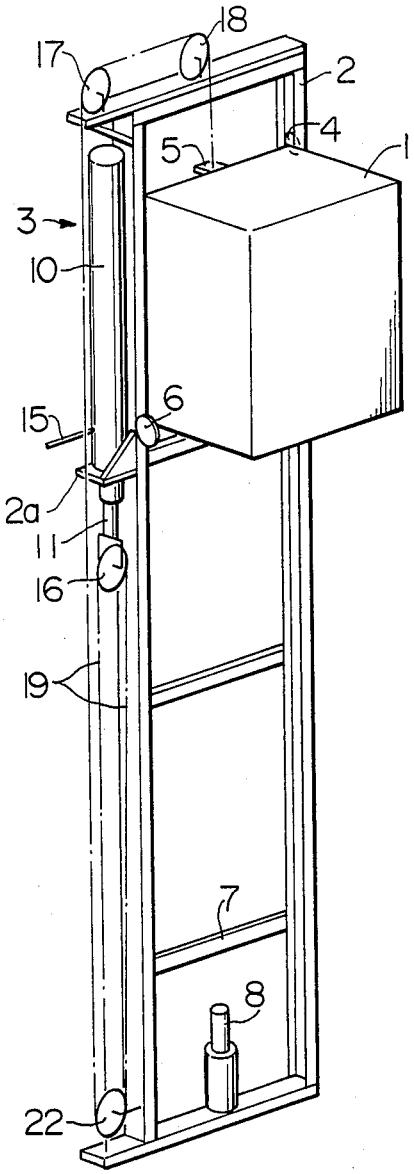
FIG. 7 is a perspective view of the fluid-pressure elevator which represents a still further embodiment of the present invention.
Figure 8:
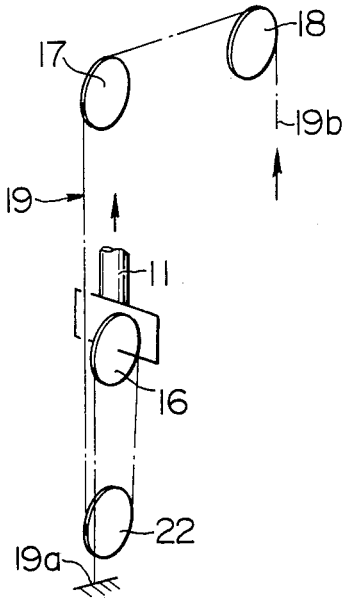
FIG. 8 is a schematic illustration of the stretched state of ropes in accordance with the embodiment of FIG. 7.

FIGS. 7 and 8 show a still another embodiment of the present invention, in which the disposition of the hydraulic pressure cylinder 10 differs from that shown in FIG. 1, and stretching of the rope is different from those shown in FIGS. 3 and 6.

As shown in FIG. 7, the fluid pressure cylinder 10 is disposed on an upper portion of the elevator frame 2 and is fixed to a support plate 2*a* on the elevator frame 2. In this case, the plunger 11 of the hydraulic cylinder 10 is disposed so as to face downward.

One end of the rope 19 is fixed to the support plate 19*a* attached to a bottom portion of the elevator frame 2, and the other end is fixed to the cage 1, the rope being supported by the pulleys 16, 17 and 18.

This arrangement ensures the same effects as those realized by the first embodiment shown in FIG. 1.

In accordance with the present invention, the cage is moved upward in response to the contraction of the plunger of the fluid pressure cylinder which constitutes the drive unit, so that a tensile force is always applied to the plunger and there is no possibility of buckling of the plunger. It is thereby possible to reduce the sizes of hydraulic devices and, hence, the size and weight of the elevator.

What is claimed is:

1. A fluid-pressure elevator in which a cage is moved in the vertical direction by controlling the rate of flow of fluid charged into and discharged from a fluid pressure cylinder, said fluid-pressure elevator comprising an elevator frame for supporting said cage, and rope means for connecting said cage and the plunger of said fluid pressure cylinder to each other while being supported by pulleys attached to an upper portion of said elevator frame, wherein said fluid pressure cylinder is attached to said elevator frame and has a dual-cylinder construction composed of an outer cylinder and an inner cylinder, a respective fluid chamber formed below a piston inserted into said inner cylinder and a fluid chamber formed above and by said outer cylinder and said inner cylinder communicating with the fluid chamber below the piston through a communication hole, wherein said fluid pressure cylinder is provided with a hydraulic pump for supplying pressure fluid to said fluid pressure cylinder by sucking fluid from the outer cylinder and supplying high pressure fluid to the fluid chamber above the piston in the inner cylinder, a motor for driving said hydraulic pump, and a control valve for controlling the rate of flow of said pressure fluid.

2. A fluid-pressure elevator according to claim 1, wherein said elevator frame has a truss structure.

* * * * *